United States Patent [19]

Akiba et al.

[11] Patent Number: 4,755,687

[45] Date of Patent: Jul. 5, 1988

[54] SYSTEM AND METHOD FOR DETECTING FLAMES

[75] Inventors: Kouji Akiba; Akira Kitajima, both of Yokohama; Yoshio Arai, Sagamihara, all of Japan

[73] Assignee: Hochiki Corp., Tokyo, Japan

[21] Appl. No.: 813,032

[22] Filed: Dec. 24, 1985

[30] Foreign Application Priority Data

Dec. 27, 1984 [JP] Japan ..... 59-199022[U]

[51] Int. Cl.[4] ..... A62C 37/18; G08B 17/12

[52] U.S. Cl. ..... 250/554; 169/61; 340/578

[58] Field of Search ..... 250/554, 342; 169/60, 169/61, 52, 26; 340/577–579, 518–519

[56] References Cited

U.S. PATENT DOCUMENTS

| | | | |
|---|---|---|---|
| 3,588,893 | 6/1971 | McCloskey | 169/61 |
| 4,023,146 | 5/1977 | Carroll . | |
| 4,082,148 | 4/1978 | Willms | 169/61 |
| 4,609,048 | 9/1986 | Yasaki et al. | 169/61 |

FOREIGN PATENT DOCUMENTS

| | | | |
|---|---|---|---|
| 0098235 | 1/1984 | European Pat. Off. | 169/61 |
| 2106385 | 4/1983 | United Kingdom | 169/61 |

*Primary Examiner*—Edward P. Westin

*Attorney, Agent, or Firm*—Lackenbach Siegel Marzullo & Aronson

[57] ABSTRACT

A system and method for detecting a fire source in a supervised region by means of fire detectors which effectively scan all over such region. A plurality of reference fire sources of the same geometric shape of the minimum size to be regareded as a fire are assumed to be located in successive predetermined position on the floor of the supervised region. Vertical control means successively sets the vertical deflection angles of each detector along the respective straight lines from each detector which graze by the upper end of the respective fire sources and to the lower end of the succeeding fire source. The system also comprises horizontal control means for causing the detectors to horizontally scan the supervised region. Upon detection of a fire, the detectors provide fire detection signals to a central processor unit which then actuates a spray nozzle to direct fire extinguishing fluid on the fire.

8 Claims, 9 Drawing Sheets

SYSTEM AND METHOD FOR DETECTING FLAMES

BACKGROUND OF THE INVENTION

1. Field of the Invention

This invention relates to a system and method for scanning a supervised region to detect and extinguish a fire occurring anywhere on the floor or wall of said region.

2. Description of the Related Art

Applicant's European patent application No. EPA-0098235 discloses an automatic fire extinguishing system in which when a fire detector for general monitoring detects the occurrence of a fire, a pair of fire source detecting apparatuses are driven to determine the position of the source of such fire and a nozzle which sprays fire extinguishing fluid is directed to that position, such position being computed by a central processing unit from the detection data provided by the fire source detecting apparatuses.

In the foregoing system, a pair of fire source detecting apparatuses each include a detector for detecting a fire source, and vertical and horizontal control means for driving the detector in the vertical and horizontal directions. When the general monitoring fire detector detects a fire, the horizontal and vertical control means drive the respective fire source detecting apparatuses so that the respective detectors comprised therein scan in the horizontal and vertical directions for the direction of the fire source.

More particularly, the vertical deflection angle of each of the detectors is initially set substantially downward. When a fire source is not detected during the first scanning operations, the vertical control means of the respective fire source detecting apparatuses is driven to reset the deflection angle of the corresponding detector by a predetermined angle upward from the original downward setting. After completion of resetting of the vertical deflection angle, the corresponding horizontal control means is driven to cause the corresponding detector to scan in the horizontal direction for the fire source. Similar searching operations are repeated until the fire source is detected. The deflection angles are set so that the successive directions of the detector are at equal angular intervals.

In such an automatic fire extinguishing system, the minimum size flame which is to be regarded as a fire is assumed to be a reference fire source, and such reference fire source is to be detected in the course of the horizontal scanning. However, since the deflection angles of the detector in the vertical direction are set at the same predetermined equal angular intervals over the entire supervised region extending from near to the fire source detecting apparatus to a position remote therefrom, there is the following problem. If the vertical deflection angles are determined based on a reference fire source located at a remote position in the supervised region, the change in the deflection angles for fire sources nearer to the detector become narrow and scanning distance on the floor of the supervised region also becomes narrow. As a result, the required number of scanning cycles is increased and rapid fire source detection cannot be attained. On the other hand, if the vertical deflection angles are determined based on a reference fire source located near to the fire source detecting apparatus, the change in the vertical deflection angles for fire sources further from the detector becomes large and results in proportionately large changes in distance to such sources. Therefore, it is necessary to subdivide the preset unit deflection angles in order to accurately detect fire sources in intermediate positions.

SUMMARY OF THE INVENTION

An object of the present invention is to provide a flame detecting method and system which is capable of more rapidly and precisely determining the position of a fire source in a region supervised by such system.

According to the present invention, in order to accurately detect the position of a fire source anywhere in the supervised region, reference fire sources of the same geometric size and of the minimum size to be regarded as a fire are assumed to be located at respective ones of successive possible positions on the floor and wall of the supervised region. The respective vertical deflection angles of the fire detector are set along respective straight lines from the detector which graze by the upper end of respective ones of such fire sources and the lower end of the succeeding fire source. This reduces the number of scanning angles to which the detector must be set for detecting a fire source in a region near to the fire source detecting apparatus, thereby reducing the time required for a scanning of the entire supervised region.

DESCRIPTION OF THE PREFERRED EMBODIMENTS

Figure 1:
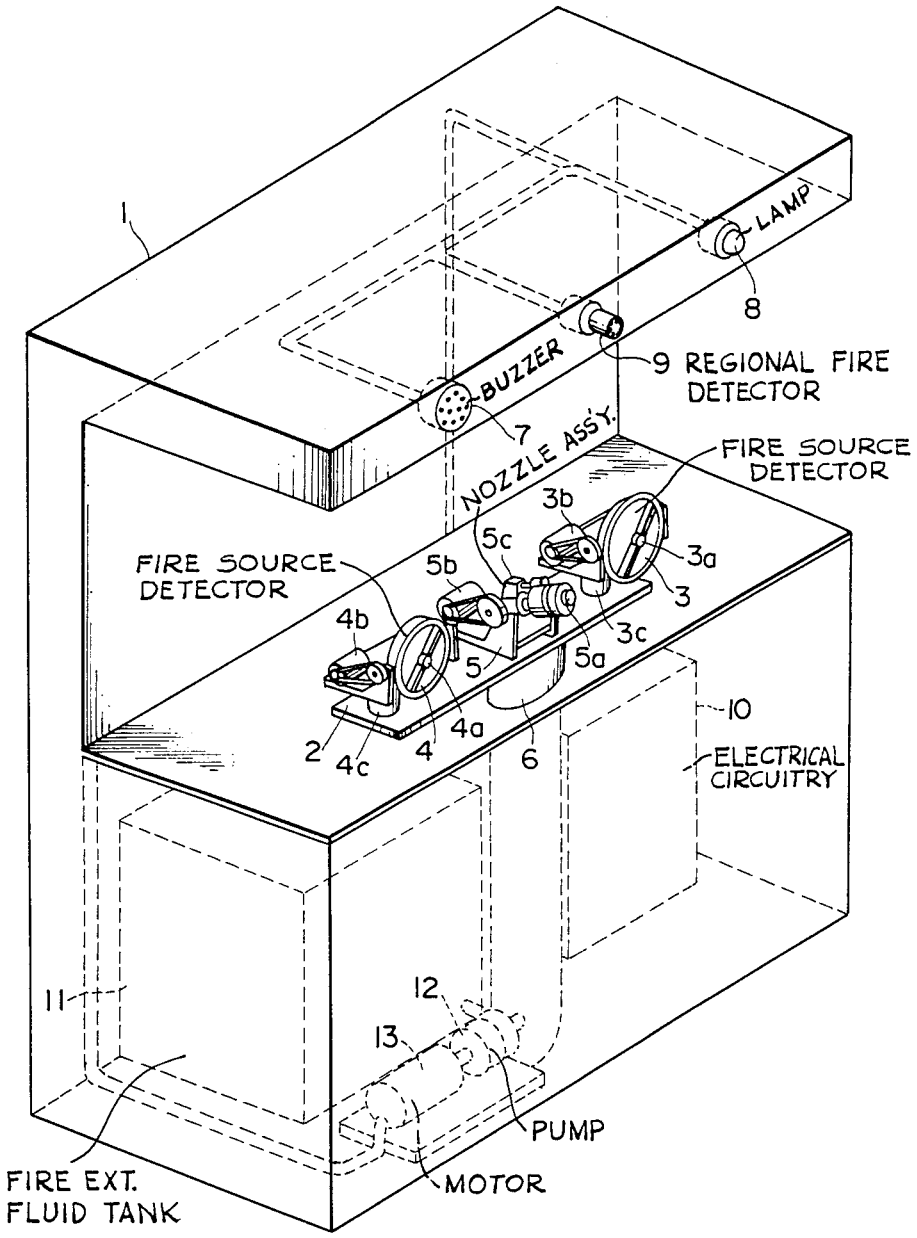
FIG. 1 shows the physical arrangement of a fire extinguishing system to which the present invention is applied.

A preferred embodiment of the present invention will now be described, referring to the drawings.

Figure 2A:
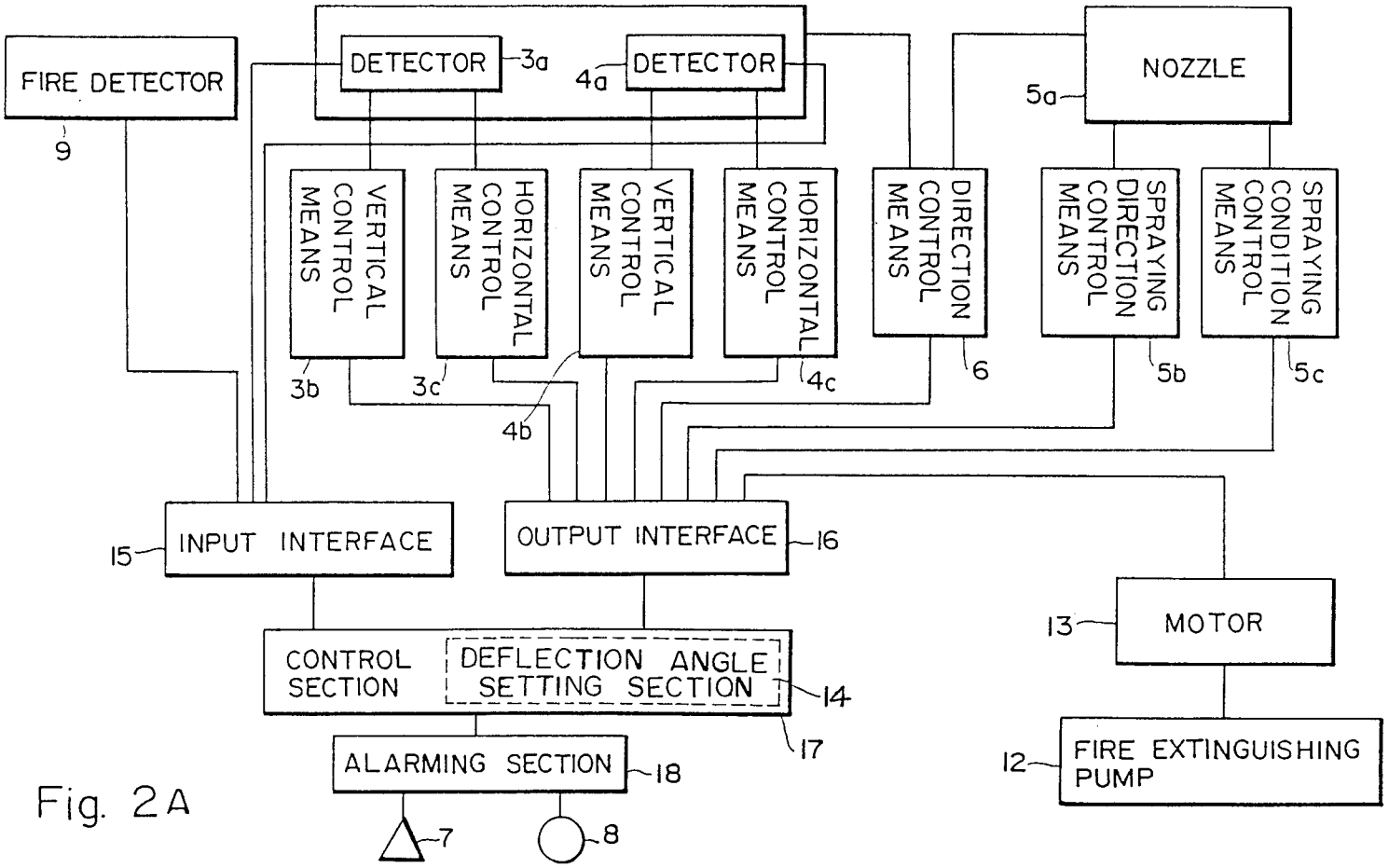
FIGS. 2(A) and 2(B) are block diagrams of circuits employed in the system shown in FIG. 1.

In FIGS. 1 and 2(A), 1 is an automatic fire extinguishing system comprising a pair of fire source detecting apparatuses 3 and 4 disposed on a table 2 at a distance therebetween. One of the fire source detecting apparatuses comprises a detector (for example, a pyroelectric element) 3*a* for detecting a fire source, a vertical control means 3*b* for controlling the detector 3*a* in the vertical direction, and a horizontal control means 3*c* for controlling the detector 3*a* in the horizontal direction. Another fire source detecting apparatus 4 similarly comprises a detector (for example, a pyroelectric element) 4*a* for detecting a fire source, a vertical control means 4*b* for controlling the detector 4*a* in the vertical direction and horizontal control means 4*c* for controlling the detector 4*a* in the horizontal direction. The vertical control means 3*b*, 4*b* and the horizontal control means 3*c*, 4*c* each separately control the corresponding detectors 3*a*, 4a, respectively, so as to drive the detectors 3a, 4a in the vertical direction and in the horizontal direction in response to an instruction from a control section 17 as will be described in detail hereinafter for detecting the position of a fire source. A nozzle assembly 5 is at the rotational center of the table 2 and comprises a nozzle 5a for spraying fire extinguishing liquid, a spraying direction control means 5b for directing the nozzle 5a towards the fire source position detected by the fire source detecting apparatuses 3, 4, and a spraying condition control means 5c for controlling the spray by adjusting the size of the opening of the spout of the nozzle 5a in accordance with the distance to a fire source. A direction control means 6 controls the horizontal rotation of the table 2 so as to direct the fire source detecting apparatuses 3, 4 and the nozzle assembly 5 conjointly towards the fire source. A buzzer 7, a lamp 8 and a fire detector 9 are provided for general fire monitoring.

Figure 6:
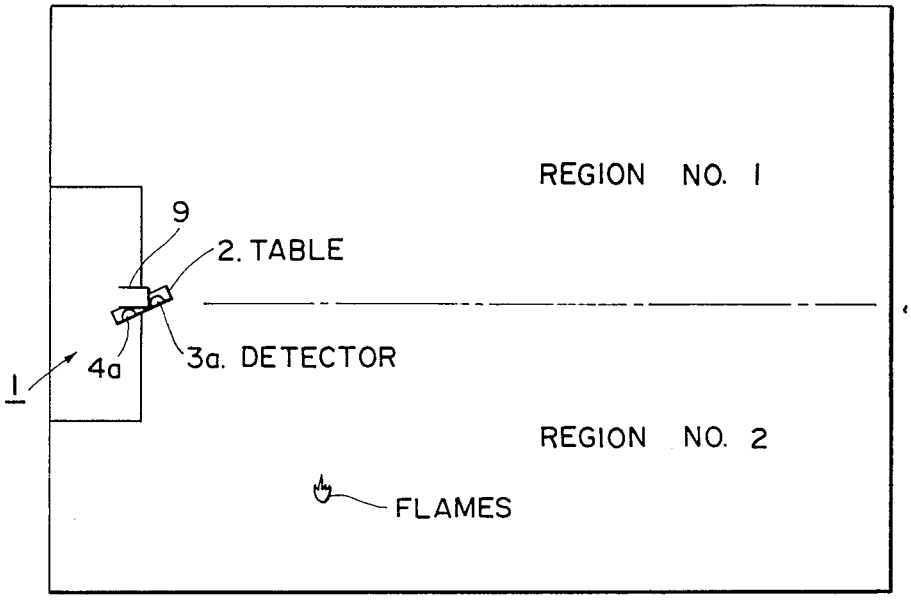
FIG. 6 is a plan view of the physical layout of the system shown in FIG. 1.

The fire detector 9 includes two detecting elements which respectively monitor regions No. 1 and No. 2 into which the supervisory region is divided as illustrated in FIG. 6. When either of the detecting elements included in the regional fire detector 9 detects a fire, it supplies a fire detection signal to a circuitry section 10. The detection signal from the fire detector 9 is input to the control section 17 through an input interface 15.

The control section 17 makes a fire determination on the basis of the detection signal from the fire detector 9, and when the control section 17 determines that there is a fire it gives an alarming section 18 an instruction to actuate the buzzer 7 and the lamp 8 for providing an alarm indication. Also, by means of output interface 16, it gives an instruction to the direction control means 6 to turn the table 2 so that the fire source detcting apparatuses 3, 4 and the nozzle assembly 5 will be directed towards the fire area, for example, towards the No. 2 region. The control section 17 includes a deflection angle setting section 14 for setting the vertical deflection angles of the detectors 3, 4.

Figure 2B:
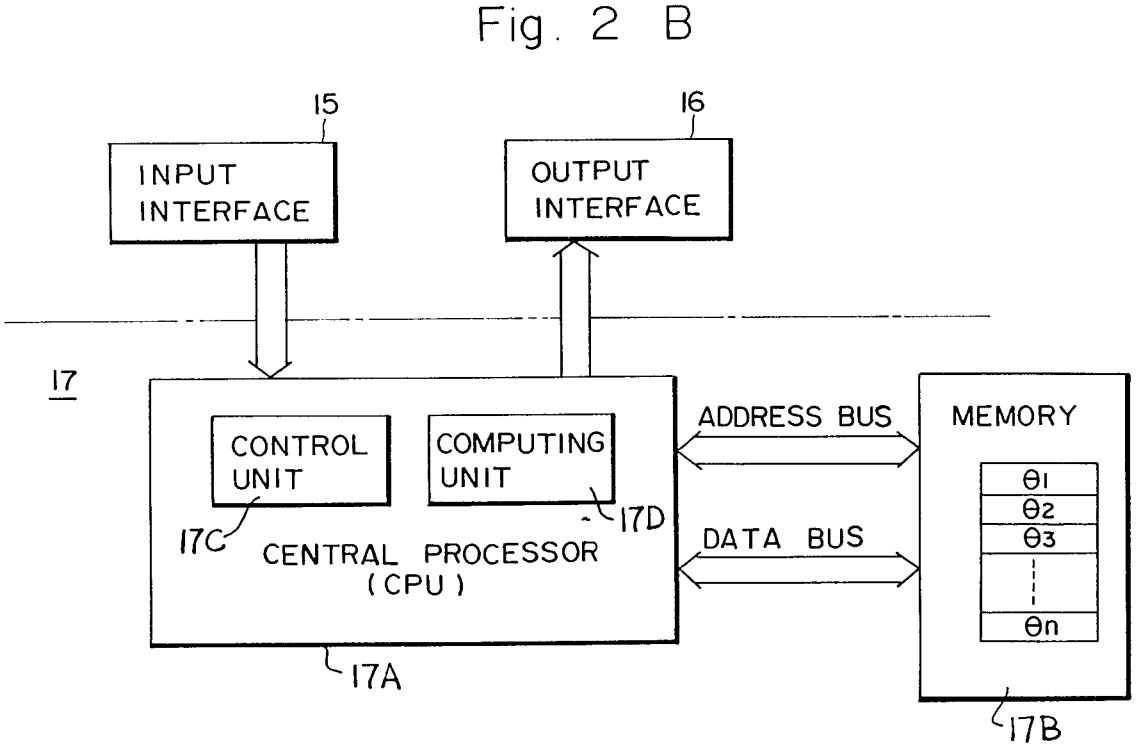

The control section 17 also includes, as shown in detail in FIG. 2(B), a central processor (CPU) 17a and a memory 17b. CPU 17a contains a control unit 17c and a computing unit 17d, and is connected with the memory 17b through a data bus and a address bus. A further data bus is provided between CPU 17a and each the input interface 15 and the output interface 16. The memory 17b stores plural deflection angle data $\theta 1 \sim \theta n$ computed by deflection angle setting section 14 in accordance with a program for computing the deflection angle and a computing program for computing a position of a fire source, as described hereinafter. The deflection angle setting section 14 is actually a combination provided by the functions of both CPU 17a and memory 17b.

CPU 17a transmits signals from the input interface 15 to the memory 17b through the address bus so as to sequentially access the deflection angle data $\theta 1 \sim \theta n$ stored in memory 17b. The vertical control means 3b and 4b are actuated in accordance with such deflection angle data.

The angle data for directions at or just below the sensors 3a, 4a, or the angle data for the angle to which sensors 3a, 4a are to be directed, can be stored in the memory 17b. However, in the present embodiment only the former case is described. In the latter case, the differential between successive deflection angles is employed. If a stepping motor is employed for driving the sensors 3a, 4a, step numbers of the stepping motor can be available to control the vertical control means 3b, 4b.

The deflection angles $\theta 1 \sim \theta n$ can be computed by using a deflection angle setting programs and can be stored in the memory 17b. Information from the sensors 3a, 4a, that is, a scanning angle in the vertical direction and a horizontal distance to the fire, are employed for such computation, and the vertical control means 3b, 4b are driven based on the result of that computation. The deflection angle setting section 14 can contain a keyboard operated switching means comprising plural switches for carrying out the program stored in the memory 17b.

The vertical control means 3b, 4b and the horizontal control means 3c, 4c are controlled as described above so that each of the fire source detecting apparatuses 3, 4 carry out a detection operation for a fire source in the one of the zones of the fire monitoring area allocated thereto, respectively. Upon receiving the fire detection signals from the fire detecting apparatuses 3, 4, the control section 17 computes the position of the fire source by trigonometrical calculation. According to the result of the computation, the direction control means 6 is again controlled to rotate the table 2 so as to direct the fire source detecting apparatuses 3, 4 and the nozzle assembly 5 conjointly towards the fire source position.

Figure 3:
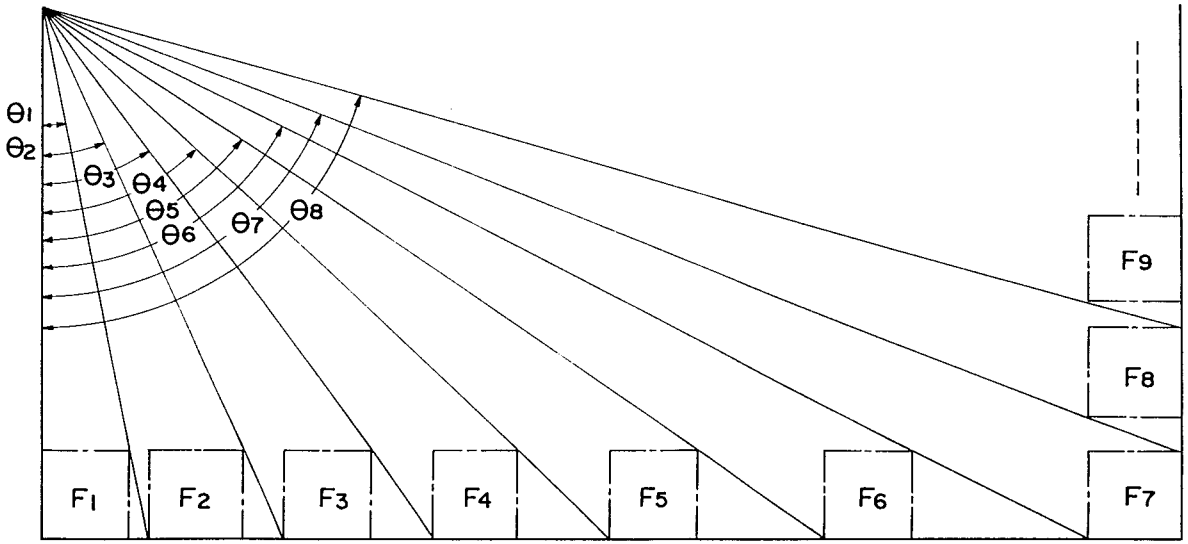
FIG. 3 is an explanatory diagram showing the settings of the vertical deflection angles of the fire detecting apparatus in FIG. 1.

FIG. 3 is an explanatory diagram showing how the deflection angles in the deflection angle setting section 14 are determined. As illustrated, reference fire sources F1, F2, . . . F8, F9, . . . having the minimum dimensions to be regarded as a fire are assumed to be at different positions on the floor and on a wall of the supervised region, and the deflection angles $\theta 1, \theta 2, \ldots \theta 8, \ldots$ in the vertical direction are respectively set along lines connecting the upper end of each reference fire source with the lower end of the adjacent reference fire source.

An example of the setting of the deflection angles will be more specifically described with reference to FIG. 4. Therein, the reference fire sources F1, F2, . . . of the minimum size to be considered as a fire of a height have h and a width of w. The maximum horizontal distance that the detectors 3a, 4a can detect is indicated as X.

Figure 4:
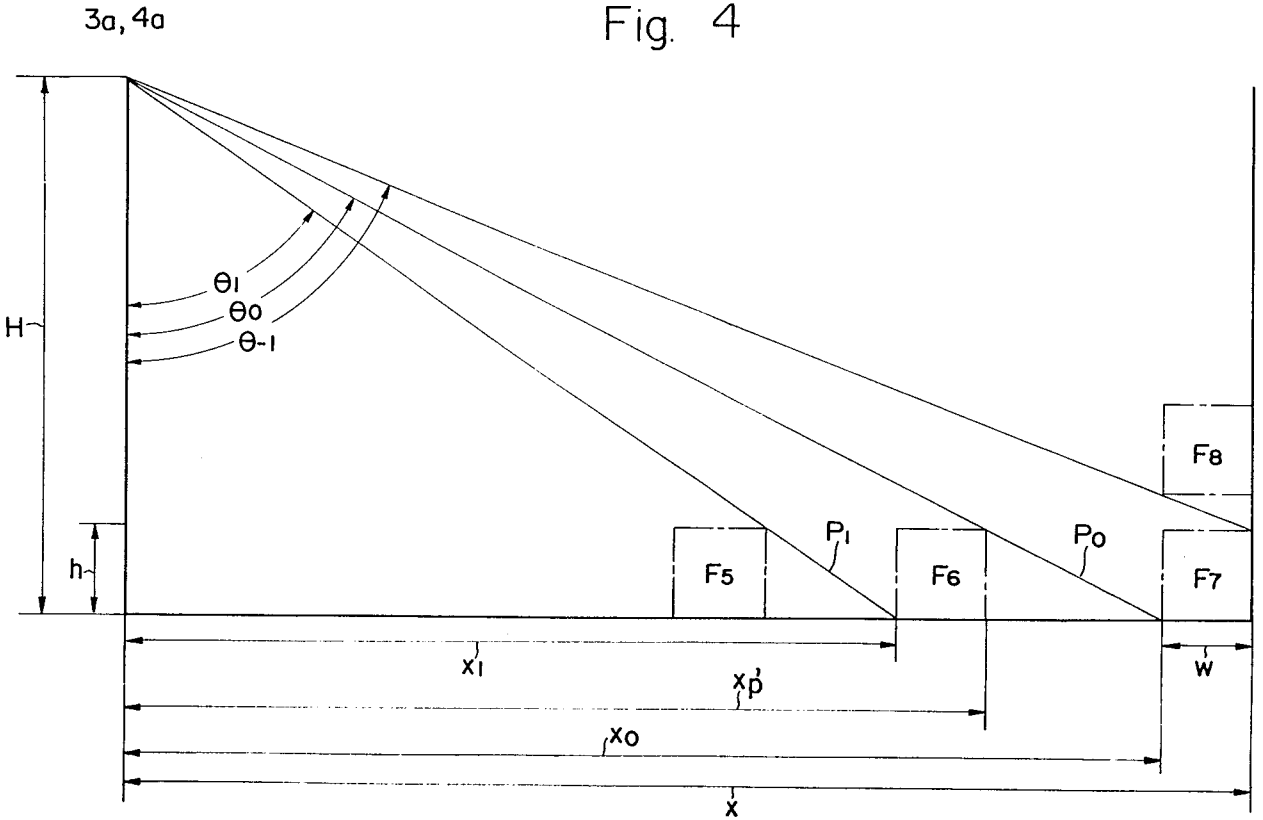
FIG. 4 is an explanatory diagram showing the basis on which the vertical deflection angles are determined.

First, it is assumed that a fire source is located at the position of the reference fire source F7 in FIG. 4. A virtual line PO is assumed so as to contact the lowermost end of the nearer side of the fire source P7. This virtual line PO, i.e., a scanning line indicative of the scanning direction of the detectors 3a, 4a, serves as a reference line. The angle between the scanning line PO and the perpendicular to the floor is assumed as $\theta 0$. Then, the following formula can be obtained:

$$\theta 0 = \cot^{-1}(H/(X-w)) \quad (1)$$

With respect to a nearer fire source F6, the scanning line PO grazes the upper end of the remote side thereof. A scanning line P1 passing through the lower end of the nearer side of the fire source F6 makes an angle $\theta 1$ with respect to a perpendicular to the floor, and can be calculated as follows: Assuming the horizontal distance to the lower end of the remote side of the fire source F6 to be X1', it will be:

$$X1' = (H-h)/\cot \theta 0 \quad (2)$$

On the other hand, the horizontal distance X1 to the lower end of the nearer side of the fire source F6 will be:

$$X1 = X1' - w \quad (3)$$

Further, $$\cot \theta 1 = H/X1 \quad (4)$$

From the formulae (2), (3) and (4), $$\theta 1 = \cot^{-1} (H\cot \theta 0/(H - h - w\cot \theta 0)) \quad (5)$$

This procedure is repeated to sequentially determine the angles to the floor defined by scanning lines from detectors 3a, 4a to the lower end of the nearer sides of respective nearer fire sources F1, F2, . . . nearer to the detectors 3a, 4a, respectively, than the reference fire source F7.

In this case, the general formula for such angles is given by:

$$\theta n = cot^{-1} (H\cot \theta n - 1/(H - h - w\cot \theta n - 1)) \quad (6)$$

where $\theta 0 \cot^{-1} (H/(X-w))$.

In order to detect a fire source located at a position of F8 on the wall and spaced by the horizontal distance X from detectors 3a, 4a, the scanning line angle $\theta - 1$ is $$\theta - 1 = \cot^{-1} ((H - h)/X) \quad (7)$$

In this case, the general formula for the angle of $(\theta - n)$ of a fire source on the wall is as follows:

$$\theta - m = \cot^{-1} ((H = mh - w \cot\theta - n/(X - w)) \quad (8)$$

If it is assumed, for example, that X=15 m, h=0.5 m and H=2 m, six or seven scanning lines will suffice to cover all over the floor in the supervisory region, and if several more scanning lines for the wall are added, the entire supervisory region can be covered. This is in contrast to the conventional equal division method, in which the angle between respective scanning lines must be only about 3 degrees so as to detect the fire source F7 of FIG. 3 under the same conditions as specified above, and almost 30 scanning lines are needed to cover only the floor.

Further, after detection of the fire source, it is not necessary to further divide the deflection angle in the vertical direction around the deflection angle at which the fire source has been detected. More particularly, since an accurate fire source position can be computed based on the detection data from the detectors 3a, 4a at the same deflection angle as used for the detection of the fire source, the detection of the fire source position can be effected based on the detection data obtained simultaneously with the fire soruce detection. This enables prompt initiation of fire fighting action.

In FIG. 1, 11 is a tank for reservoiring a fire extinguisher liquid such as an extinguisher agent or water, 12 is a pump for feeding the extinguisher liquid from the tank 11 to the nozzle 5a, and 13 is a motor. When the motor 13 is actuated in response to an instruction from the control section obtained through an output interface 16, the fire extinguishing pump 12 is driven to feed the extinguisher liquid to the nozzle 5a for initiating the fire fighting action.

The operation of the apparatus as illustrated will be described referring to FIG. 4, FIG. 5(A) and (B) and also FIG. 6.

Figure 5A:
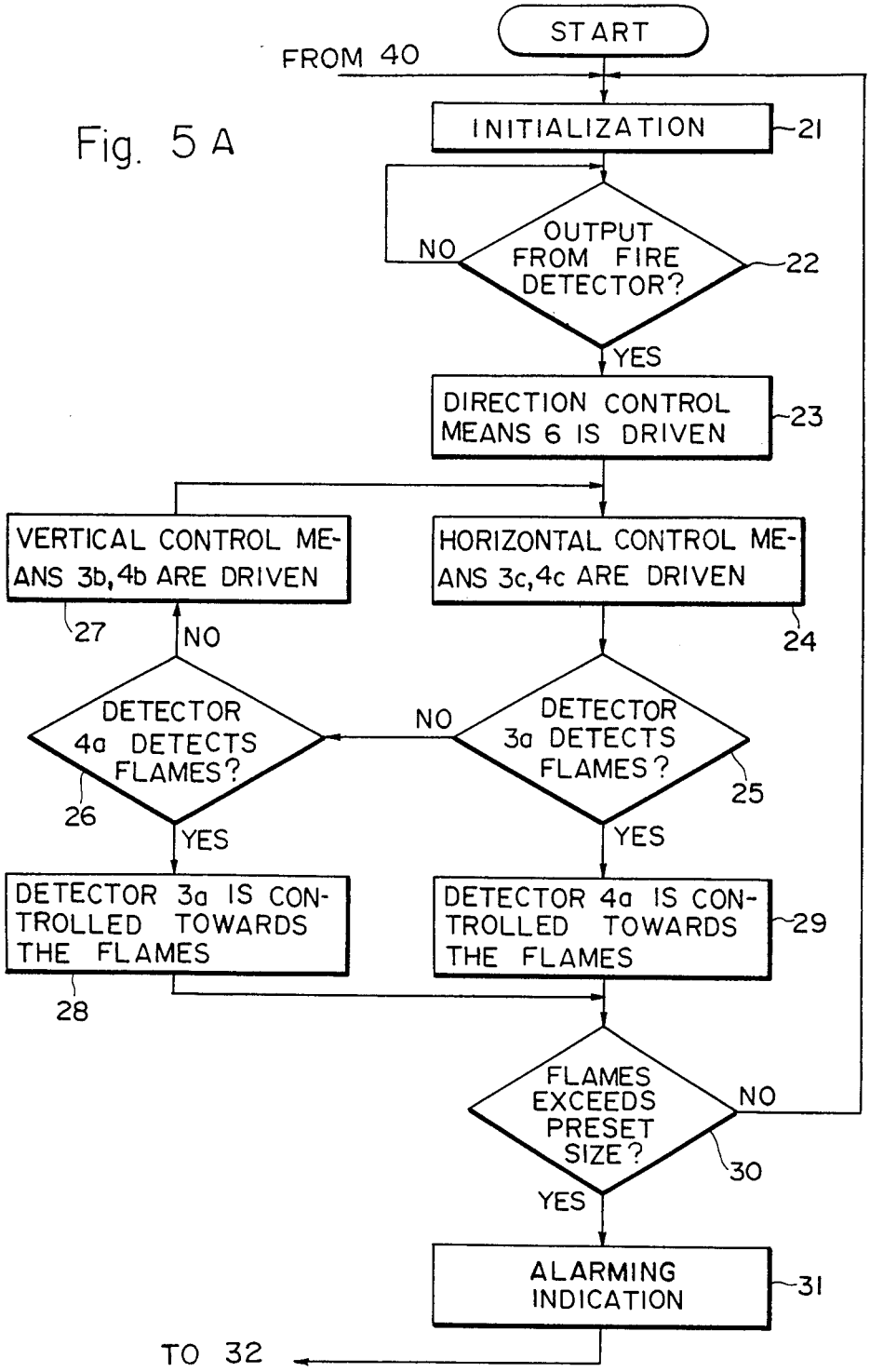
FIGS. 5(A) and 5(B) are flow charts showing the operation of the system in FIG. 1.
Figure 5B:
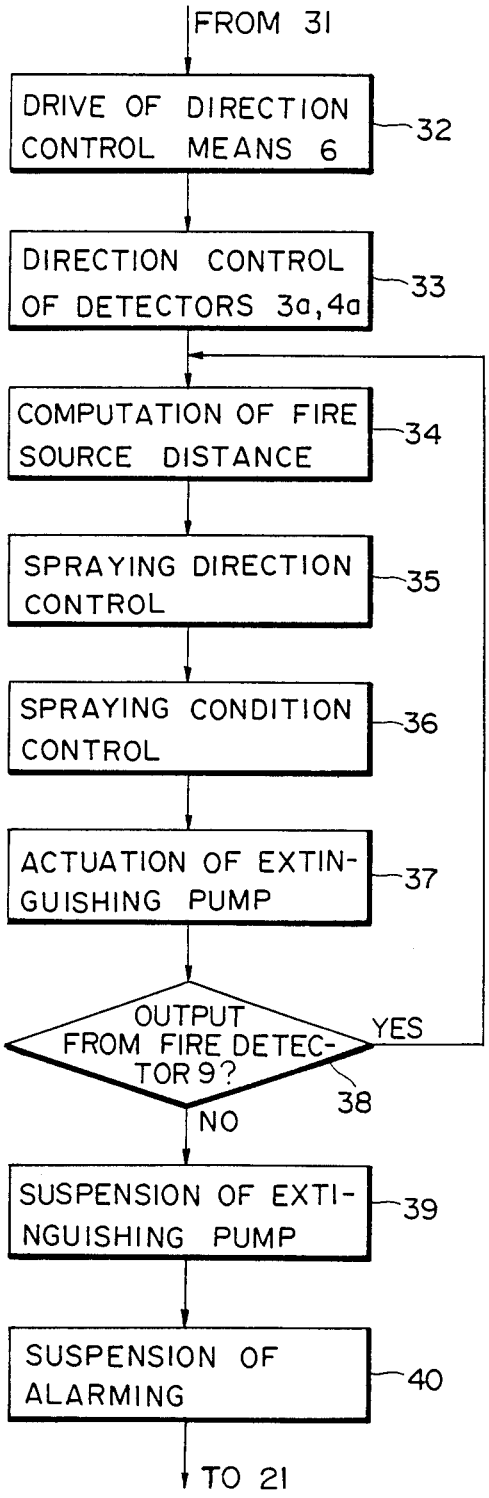

In FIG. 5(A) and (B), initialization of operation is effected at block 21. For example, the horizontal control means 3c, 4c and the direction control means 6 are controlled to adjust the rotation angle of the table 2 so that the detectors 3a, 4a and the nozzle 5a may be conjointly directed forwardly. The vertical control means 3b, 4b are controlled to set the vertical deflection angles of detectors 3a and vertically downward towards the substantially central portion of the supervisory region, e.g. at an angle $\theta 4$ as shown in FIG. 3. At block 22 in FIG. 5A, the fire detector 9 monitors each of the monitoring regions for occurrence of a fire. For example, if a fire has started in the region No. 2 as illustrated in FIG. 6, the fire detector 9 detects a flame and in FIG. 5A the step proceeds from block 22 to block 23 to drive the direction control means 6. That turns the table 2 in the horizontal direction so that the detectors 3a, 4a and the nozzle 5a are conjointly directed towards the region No. 2. Then at block 24, the horizontal control means 3C and 4C are driven to cause detectors 3a, 4a to carry out a flame detecting operation.

The vertical deflection angle of the detectors 4a is now set to be vertically downward and the deflection angle of the detector 3a is now set at an angle $\theta 4$ as described above. The control section 17 actuates the horizontal control means 3c, 4c to let the detectors 3a, 4a scan in the horizontal direction in the region No. 2, keeping the initially set deflection angle of the detectors 3a, 4a. At block 25, it is determined whether the detector 3a detects a flame or not. When a flame is not detected, in FIG. 5A the step proceeds to block 26 where the detection data from the detector 4a is read. If flame detection data is not obtained at block 26, either, the step proceeds to block 27 where the control section 17 drives the vertical control means 3b, 4b to deflect the angles of the respective detectors 3a, 4a by predetermined angles upwardly. More specifically, as illustrated in FIG. 3, the deflection angle in the vertical direction of the detector 4a is reset from the vertically downward direction to an angle $\theta 1$ and the deflection angle of the detector 3a is reset from the angle $\theta 4$ to an angle $\theta 5$. The step further proceeds to block 24 to drive the horizontal control means 3c, 4c to let the detectors 3a, 4a scan in the horizontal direction in the region No. 2, while keeping the deflection angles of the detectors 3a, 4a at $\theta 5$ and $\theta 1$, respectively.

Similarly, the deflection angles of the respective detectors 3a, 4a in the vertical direction are controlled so as to stepwise reset upwardly by predetermined angles based on the preset deflection angle setting program. Control is further made so that the detectors 3a, 4a scan horizontally in the region No. 2 at the respective deflection angles to repeat the flame searching operation.

If the detector 4a detects a flame after some searching operations by the detector, 4a, the step proceeds from block 26 to block 28 where the control section 17 drives the horizontal control means 3c and the vertical control means 3b of the fire source detecting apparatus 3 to direct the detector 3a towards the flame. Similarly, if detector 3a detects a flame, the step proceeds from block 25 to block 29 where control section 17 drives the horizontal and vertical control means 4c and 4b of fire source detecting apparatus 4 to direct detector 4a toward the flame. At block 30, the control section 17 determines the size of the flame based on the data from the detector 3a, 4a, and if the size of the flame is not larger than a predetermined size it is determined as a non-fire and the step returns to block 21. Thus, the step is reset to the initial conditions in preparation for further monitoring of fire occurrence.

On the other hand, if the control section determines, at block 30, that the size of the flame exceeds the predetermined size and it is a fire, the step proceeds to block 31 to actuate the buzzer 7 and light the lamp 8 for block 32 where the direction control means 6 is driven to rotate the table 2 so that the fire source detecting apparatuses 3, 4 and the nozzle assembly 5 are conjointly directed towards the flame. At block 33, the directing angles of the detectors *3a*, *4a* are re-adjusted because they are deflected from the fire as a result of the rotation of the table 2. For this purpose, the horizontal control means *3c*, *4c* are operated to direct the detectors *3a*, *4a* towards the flame.

At block 34, the detection data is gathered under the condition where the detectors *3a*, *4a* are directed towards the flame and the control section 17 computes the accurate flame position, i.e., the distance to the flame and the height of the flame based on the detection data from the detectors *3a*, *4a*. The control section 17 controls the nozzle assembly 5 according to the result of the computation and it operates, at block 35, the spraying direction control means *5b* to control the directing angle in the vertical direction of the nozzle *5a* so that the spout of the nozzle may be directed towards the flame. The control section 17 operates, at block 36, the spraying condition control means *5c* to adjust the opening degree of the spout of the nozzle *5a*. Thus, the extinguishing liquid spraying condition is controlled. At block 37, the motor 13 is actuated by an instruction from the control section 17 to operate the extinguishing pump 12; so as to spray the fire extinguishing liquid from the nozzle *5a* for initiating a fire-fighting action. At block 38, it is montored whether the fire has been extinguished or not bsed on the detection data from the fire detector 9. When the fir has not been completely extinguished, the step returns from block 38 to block 34 and the control section 17 again computes the fire source position based on the detection data from the detectors *3a*, *4a* and re-adjusts the spraying direction an spraying conditon of the nozzle *5a* according to the computation result to continue the fire-fighting action. If it is confirmed that the fire has been completely extinguished at block 38, the step proceeds to block 39 to stop the operations of the motor 13 and the fire extinguishing pump 12 so as to suspend the fire-fighting ction. At block 40, the buzzer 7 and the lamp 8 are switched off to suspend the alarming. Then, the step returns to block 21 to reset the directing angles of the respective detectors *3a*, *4a* to the initial conditions for further fire monitoring.

The initial deflection angle of the detector *3a* in the vertical direction at block 21 is set at the angle $\theta 4$ which directs the substantially central portion of the floor in the region in the embodiment as described above. However, the respective deflection angles $\theta 1$, $\theta 2$, $\theta 3 \ldots, .\theta 8$, . . . necessary for scanning all over the supervisory region are preliminarily set according to the configuration and size of the supervisory region, and the number of the scanning lines in the vertical direction necessary to scan all over the supervisory region can be computed. Consequently, the initial deflection angle of the detector *3a* in the vertical direction may be set to the direction corresponding to the middle scanning line. In this case, the fire searching operation in the entire supervisory region which includes the floor and the wall can be carried out effectively.

Figure 7:
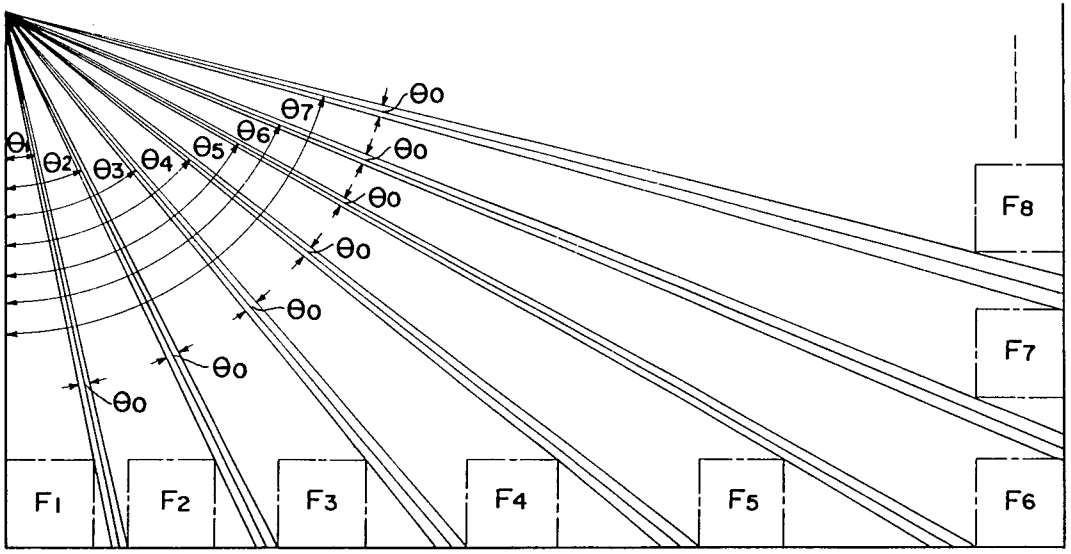
FIG. 7 is an explanatory diagram showing another possible basis for determining the vertical deflection angles.

FIG. 7 shows another method for setting the deflection angles. In FIG. 7, since the detectors *3a*, *4a* for detecting infrared rays from the flames have a certain angle $\theta 0$ of field of view, the scanning lines are imagined to be within said angle $\theta 0$. More specifically, the deflection angles $\theta 1$, $\theta 2$, $\theta 3$, . . .,$\theta 7$, . . . in the vertical direction are set along respective scanning lines centered between lines connecting to the upper ends of successive reference fire sources and liner connecting to the lower ends of the succeeding fire sources. In this case, the formulae as given above can be applied but in somewhat modified form. The pyroelectric elements, such as a photodiode, phototransistor, etc. usually used as a detector, have an angle $\theta 0$ of field of view which is small enough to be negligible. Also, they are adjusted by the opticalmeans to receive light only in the horizontal direction. Therefore, in many cases, it is unnecessary to set the deflection angles $\theta 1$, $\theta 2$, . . . as illustrated in FIG. 7.

What is claimed is:

1. An improved flame detecting system for detecting a fire source in a supervised region having a floor, which system comprises a detector for detecting a fire source; vertical control means for driving said detector to carry out vertical scanning of the supervised region; and horizontal control means for driving said detector to carry out horizontal scanning of the supervised region; such improvement being characterized in that said system further comprises:

deflection angle setting means for successively setting said detector at successive vertical deflection angles corresponding to successive predetermined positions on the floor of the supervised region of reference fire sources of the same geometric shape and size and having an upper end and a lower end, such size being of the minimum dimensions to be regarded as a flame in the supervised region, the lower end of each of such reference fire sources being on the floor of the supervised region;

such vertical deflection angles respectively being along respective straight lines extending from said detector which graze by the upper end of respective ones of said fire sources and the lower end of the succeeding reference fire source; and control means for controlling the vertical control means to drive said detector in accordance with vertical deflection angle signals provided by said deflection angle setting means.

2. A flame detecting system according to claim 1, wherein said reference fire source is of rectangular shape.

3. A flame detecting system according to claim 1, wherein said deflection angle setting means comprises a central processing unit for determining angle data corresponding to the successive vertical deflection angles and memory means for storing such angle data therein at respective addresses.

4. A flame detecting system according to claim 3, wherein said angle data for each vertical deflection angle signifies the angle from the vertical directed just under the detector.

5. A flame detecting system according to claim 3, wherein said angle data for each vertical deflection angle signifies the angle from an existing position of the detector to a succeeding position thereof.

6. A flame detecting system according to claim 1, wherein said deflecting angle setting means comprises a central processing unit and means for storing a program for enabling said central processing unit to compute the successive vertical deflecting angles, and said system further comprises means for inputting to said central processing unit the horizontal distances from said detector to each of said reference fire sources.

7. A flame detecting system according to claim 1, wherein the supervised region is divided into two regions, and further comprising second detector, the two detectors respectively scan each of such divided supervised regions.

8. A method of operation of a flame detecting system which comprises a detector for detecting a fire source in a supervised region having a floor, vertical control means for driving the detector to effect scanning in the vertical direction, and horizontal control means for driving the detector to effect scanning in the horizontal direction; such method comprising:

successively setting said detector at successive vertical deflection angles corresponding to successive predetermined positions on the floor of the supervised region of reference fire sources of the same geometric shape and size and having an upper end and a lower end, search size being of the minimum dimensions to be regarded as a flame in the supervised region, the lower end of each reference fire source being on the floor of the supervised region; such vertical deflection angles respectively being along respective straight lines extending from said detector which graze by the upper end of respective ones of said reference fire sources and the lower end of the succeeding reference fire source; and horizontally deflecting the detector while it is at each of said vertical deflection angles.

* * * * *